US008870724B2

(12) United States Patent
Armitage et al.

(10) Patent No.: US 8,870,724 B2
(45) Date of Patent: Oct. 28, 2014

(54) DEVICE FOR EXERCISING OR SUPPORTING THE PELVIC FLOOR MUSCLES

(75) Inventors: Carol Armitage, Palmerston North (NZ); Ralph Elliott Schneideman, Kapiti Coast (NZ); Patricia Ann Coombes, Kapiti Coast (NZ)

(73) Assignee: Orelle Holdings Limited, Palmerston North (NZ)

( * ) Notice: Subject to any disclaimer, the term of this patent is extended or adjusted under 35 U.S.C. 154(b) by 1281 days.

(21) Appl. No.: 12/312,703

(22) PCT Filed: Nov. 20, 2007

(86) PCT No.: PCT/NZ2007/000341

§ 371 (c)(1),
(2), (4) Date: Feb. 8, 2010

(87) PCT Pub. No.: WO2008/063085

PCT Pub. Date: May 29, 2008

(65) Prior Publication Data

US 2013/0005543 A1 Jan. 3, 2013

(30) Foreign Application Priority Data

Nov. 20, 2006 (NZ) ..... 551400

(51) Int. Cl.
*A63B 23/00* (2006.01)
*A63B 23/20* (2006.01)
*A61H 21/00* (2006.01)

(52) U.S. Cl.
CPC ..... *A63B 23/20* (2013.01)
USPC ..... 482/131; 482/148; 482/121; 482/91; 600/38; 600/29; 600/591

(58) Field of Classification Search
USPC ..... 600/38; 482/91; 128/830–840
See application file for complete search history.

(56) References Cited

U.S. PATENT DOCUMENTS 1,615,728 A * 1/1927 Smith ..... 128/834
2,507,858 A * 5/1950 Kegel ..... 600/591

(Continued)

FOREIGN PATENT DOCUMENTS

CA 2671512 A1 5/2008
DE 10226833 A1 1/2004

(Continued)

OTHER PUBLICATIONS

International Search Report Received in International Application No. PCT/NZ2007/000341 dated Mar. 20, 2008, 2 pages.

*Primary Examiner* — Stephen Crow
*Assistant Examiner* — Rae Fischer
(74) *Attorney, Agent, or Firm* — Davis Wright Tremaine LLP; Heather M. Colburn; George C. Rondeau, Jr.

(57) ABSTRACT

A device (101) for supporting or exercising the pelvic floor muscles in a female human. The device has a unitary elongate body having a first enlarged end (103), a second enlarged end (105), and a relatively narrow interconnecting region (107) that interconnects the first enlarged end and the second enlarged end. The first enlarged end (103) generally extends in a first direction from the interconnecting region (107) and from one end of the interconnecting region. The second enlarged end (105) generally extends in a second generally opposite direction from the interconnecting region (107) and from the other end of the interconnecting region. The first enlarged end (103), the second enlarged end (105), and the narrow interconnecting region (107) are substantially fully insertable into the vagina to provide resistance to contraction of the pelvic floor muscles.

27 Claims, 8 Drawing Sheets

(56) References Cited

U.S. PATENT DOCUMENTS

| | | | | | |
|---|---|---|---|---|---|
| 2,574,767 | A | * | 11/1951 | Stubbs | 128/834 |
| D171,270 | S | * | 1/1954 | Sweeney | D7/653 |
| 4,241,912 | A | * | 12/1980 | Mercer et al. | 482/91 |
| 4,881,526 | A | | 11/1989 | Johnson et al. | |
| 4,895,363 | A | * | 1/1990 | Plevnik et al. | 482/105 |
| 5,389,068 | A | * | 2/1995 | Keck | 604/15 |
| 5,483,832 | A | * | 1/1996 | Pauser et al. | 73/379.08 |
| 5,603,685 | A | * | 2/1997 | Tutrone, Jr. | 600/29 |
| 5,688,260 | A | * | 11/1997 | Blanton | 604/11 |
| 5,931,775 | A | | 8/1999 | Smith | |
| 6,165,108 | A | * | 12/2000 | Ralston | 482/91 |
| 6,265,640 | B1 | * | 7/2001 | Albertsen et al. | 800/303 |
| 6,394,939 | B1 | | 5/2002 | Stein | |
| 7,001,317 | B2 | * | 2/2006 | Marcotte | 482/148 |
| 8,512,226 | B2 | * | 8/2013 | Mark | 600/38 |
| 2002/0000233 | A1 | * | 1/2002 | Jude | 128/897 |
| 2005/0148447 | A1 | * | 7/2005 | Nady | 482/121 |

FOREIGN PATENT DOCUMENTS

| | | | | |
|---|---|---|---|---|
| DE | 102 26 833 | | * | 8/2004 |
| GB | 2457838 | A | | 9/2009 |
| NZ | 551400 | | | 11/2006 |
| WO | 01/30457 | A1 | | 5/2001 |
| WO | 01/37732 | A1 | | 5/2001 |
| WO | 2005/070504 | A2 | | 8/2005 |

* cited by examiner

DEVICE FOR EXERCISING OR SUPPORTING THE PELVIC FLOOR MUSCLES

CROSS-REFERENCE TO RELATED APPLICATIONS

This patent application is a U.S. National Phase application under 35 U.S.C. §371 of International Application No. PCT/NZ2007/000341, filed on Nov. 20, 2007, entitled DEVICE FOR EXERCISING OR SUPPORTING THE PELVIC FLOOR MUSCLES, which claims priority to New Zealand patent application number 551400, filed Nov. 20, 2006.

FIELD OF THE INVENTION

The invention relates to devices for supporting or exercising the pelvic floor muscles.

BACKGROUND TO THE INVENTION

The pelvic floor muscles enclose the vagina and the abdomino-pelvic cavity. These muscles support the pelvic organs and control the close and release of their outlets. If the support and control mechanisms of the pelvic floor muscles are compromised pelvic organ dysfunction can result.

Muscle is generally made up of two types of fibres; the type I slow twitch fibres, which act for longer periods, and the type II fast twitch fibres which contract quickly for rapid movement. The slow twitch fibres of the pelvic floor muscles act to support the lower internal organs and also to help the bladder retain urine for long periods. The fast twitch fibres provide extra support to retain urine during times of stress, such as when lifting heavy objects, laughing, coughing or sneezing.

Pelvic organ dysfunction may occur when the pelvic floor muscles are stretched.

Many circumstances can result in the pelvic floor muscles becoming over-relaxed or stretched, but pregnancy and childbirth are the most common cause. Obesity, hysterectomy, bowel disorders, and other medical conditions can also affect the functioning of the pelvic floor muscles. Even in otherwise healthy women, factors such as lifestyle, aging, and hormonal changes can have a negative effect.

Weakened pelvic floor muscles may lead to urinary incontinence. To urinate, the muscles surrounding the bladder contract and squeeze the urine out through the urethra. The urethra passes through the pelvic floor muscles supporting the bladder, bowel and uterus. If the pelvic floor muscles are weak they are unable to close off the urethra effectively, leading to leakage of urine. Stress incontinence is urine loss that occurs when there is increased pressure in the abdomen. This commonly occurs during coughing, sneezing, laughing, lifting and exercise. Urge incontinence is the loss of urine associated with a sudden strong desire to urinate that cannot be postponed.

Urge incontinence is generally triggered by certain events such as the sound or sensation of running water, sudden exposure to cold or fumbling with the front door keys trying to open the door. Urge incontinence has also been described as overactive bladder.

Some women suffer from mixed incontinence and experience a combination of both symptoms.

If the pelvic floor muscles are sufficiently stretched or weakened a woman may experience pelvic organ prolapse. In pelvic organ prolapse the organs of the pelvis may drop down out of their normal position causing a feeling of pelvic pressure or heaviness in the pelvic region.

Pelvic support problems include cystocele, where the bladder is not supported properly; enterocele, where the small intestine is not supported properly; rectocele, where the rectum is not supported properly; uterine prolapse, where the uterus is not supported properly; and vaginal prolapse, where the vagina is not supported properly. In some cases pelvic organ prolapse requires surgery.

Furthermore, because many of the sensations experienced during sexual intercourse result from stimulation and contraction of the pelvic floor muscles, loss of tone of the pelvic floor muscles can also lead to a reduction in sexual responsiveness.

Damage to the pelvic floor muscles may also be associated with neural damage. In particular, pregnancy and childbirth can stretch the nerves connecting the pelvic floor muscles to the brain. If these nerves are damaged so that they cannot provide proper sensory feedback, the woman may not be able to coordinate the muscle contractions needed for urinary continence. Sexual enjoyment may also be decreased.

The pelvic floor muscles can be strengthened by regularly contracting and relaxing them. The most common form of pelvic floor exercises are known as Kegel exercises. Unfortunately, the women most in need of pelvic floor muscle training may have experienced stretching of the muscles and neural damage that prevents them from being able to properly sense the muscle contractions. Therefore, pelvic floor exercises may not be effective.

A number of devices have been developed the help exercise the pelvic floor muscles. These devices generally involve a portion that is inserted into the vagina, to provide resistance for the pelvic floor muscles to contract against. Examples of such devices are outlined below.

U.S. Pat. No. 4,241,912 teaches a device that has a section that is inserted into the vagina, and an outer flange and handle which prevent full insertion. The body of the device is shaped to fit into the vagina and is substantially rigid. Because the device is not fully insertable, it can only be used in limited situations.

U.S. Pat. No. 4,895,363 teaches a series of weighted cones that are inserted into the vagina. Once inserted the patient contracts the pelvic floor muscles and attempts to prevent the weighted cones from falling out. Because the exercise only involves the contraction and holding of the pelvic floor muscles, only the slow twitch muscles are targeted. The exercises can also only be performed in limited circumstances.

U.S. Pat. No. 5,931,775 teaches a device consisting of a handle portion and a cylindrical projection that has a solid inner wall and an outer compressible sleeve. The cylindrical projection is inserted into the vagina and the compressible sleeve provides resistance against which the pelvic floor muscles can be contracted. The handle portion also means that it cannot be fully inserted into the vagina, limiting where and how the exercises are performed.

WO 01/37732 teaches a device for both measuring and exercising the pelvic floor muscles. It includes a probe having a pressure sensor and vibrator, linked to an external microprocessor. The device is used by inserting the probe into the user's vagina and firstly measuring the maximum highest contraction value achieved when the user contracts the pelvic floor muscles. Secondly, the vibrator is activated during further contractions of the pelvic floor muscles in accordance with a predetermined relationship between the strength of the pelvic floor contraction and the highest value. The device according to WO 01/37732 is expensive and difficult to use. The external microprocessor limits or restricts the positions that exercises can be performed in.

WO 01/30457 teaches a number of small devices for exercising the pelvic floor muscles. Resistance in the devices is achieved either by springs, fluids of compressible material. None of the devices taught in WO 01/30457 are completely insertable. This means that they can only be used in private situations and cannot be linked to functional training where most stress incontinence occurs, ie, when the user is walking, running or coughing etc.

WO2005/070504 describes a device having an indicator that protrudes from an end of the device as the muscles are contracted. Accordingly, the device can only be used in limited situations, and cannot be used for extended periods.

U.S. Pat. No. 6,394,939 describes an exercise device having a shaft portion, a head portion at one end and a gripper at the other end. At least a portion of the shaft is compressible. The gripper is a rectangular body, which would prevent insertion of the entire device, limiting where and how the exercises are performed.

U.S. Pat. No. 5,483,832 describes a device for monitoring the contractibility of the pelvic floor muscles. The device has a probe with a first and second end and a number of chambers defined by an elastically deformable membrane. The device is connected to a measurement display device by a measurement line, limiting where the device can be used.

WO 00/41772 describes a device having an elongate body that has a reduced cross section in its middle section. This device cannot be fully inserted into the vagina, limiting where and how the exercises are performed.

U.S. Pat. No. 7,001,317 describes a Kegel exercising device. The device has a first sphere and a second sphere with an intermediate portion. The device is cast from surgical steel. One end of the device is inserted vaginally, and the other end of the device is inserted rectally which may be off-putting to some women.

With the devices above, the user may not be able to properly sense the pelvic floor muscles contracting and relaxing. Consequently, the user may be unsure as to whether she is performing the exercises correctly.

In this specification where reference has been made to patent specifications, other external documents, or other sources of information, this is generally for the purpose of providing a context for discussing the features of the invention. Unless specifically, stated otherwise, reference to such external documents or such sources of information is not to be construed as an admission that such documents or such sources of information, in any jurisdiction, are prior art or form part of the common general knowledge in the art.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

It is an object of at least preferred embodiments of the present invention to provide a device that is suitable for insertion into the vagina to support the pelvic floor muscles or to provide satisfactory resistance for exercising the pelvic floor muscles, or that at least provides the public with a useful choice.

SUMMARY OF THE INVENTION

The term "comprising" as used in this specification means "consisting at least in part of"; that is to say when interpreting statements in this specification which include "comprising", the features prefaced by this term in each statement all need to be present but other features can also be present. Related terms such as "comprise" and "comprised" are to be interpreted in similar manner.

In accordance with a first aspect of the present invention, there is provided a device for supporting or exercising the pelvic floor muscles in a female human, comprising a unitary elongate body having a first enlarged end, a second enlarged end, and a relatively narrow interconnecting region that interconnects the first enlarged end and the second enlarged end, the first enlarged end generally extending in a first direction from the interconnecting region and from one end of the interconnecting region, and the second enlarged end generally extending in a second generally opposite direction from the interconnecting region and from the other end of the interconnecting region, wherein the first enlarged end, the second enlarged end, and the narrow interconnecting region are substantially fully insertable into the vagina to provide resistance to contraction of the pelvic floor muscles.

Preferably, the first direction extends from a first side of an axis extending through the interconnecting region and the second direction extends from an opposite, second side of the axis extending through the interconnecting region.

The first and second enlarged ends are preferably generally parallel.

The interconnecting region is preferably relatively narrow compared to the ends, in at least one dimension of the interconnecting region. For example, a width of the interconnecting region may be relatively narrow compared to the widths of the ends. Alternatively, a depth of the interconnecting region may be relatively narrow compared to depths of the ends. Preferably, at least a depth of the interconnecting region is relatively narrow compared to depths of the ends. Most preferably, the width of the interconnecting region is relatively narrow compared to the widths of the ends and the depth of the interconnecting region is relatively narrow compared to the depths of the ends.

The interconnecting region preferably has a narrower depth and width than the enlarged ends, to minimise or prevent unwanted longitudinal movement of the device once inserted in the vagina.

Preferably, the first enlarged end is intended to be inserted more deeply into the vagina than the second enlarged end.

The first enlarged end preferably comprises a first surface that is generally concave when viewed from an exterior of the device, and a second, opposite surface that is generally convex when viewed from the exterior of the device, such that the first enlarged end defines an overall curvature.

The first enlarged end preferably has a perimeter extending between the first surface and second surface, wherein the perimeter is generally convex when viewed from the exterior of the device.

The first enlarged end preferably comprises a tip that is configured to apply pressure against the anterior vaginal wall, at or near the position of the bladder neck or Grafenberg spot (G-spot) to provide sensation to aid biofeedback to a user.

The second enlarged end is preferably generally bulbous, with first and second opposite surfaces that are generally convex when viewed from the exterior of the device. The second enlarged end preferably has a perimeter extending between the first surface and the second surface, wherein the perimeter is generally convex when viewed from the exterior of the device.

Preferably, the concave surface of the first enlarged end, an adjacent surface of the interconnecting region, and part of an adjacent surface of the second enlarged end form a continuous curved surface that is generally concave or scooped when viewed from the exterior of the device, and is configured to accommodate the protrusion in the anterior vaginal wall formed by the pubic bone.

The device preferably has a generally sinuous shape along its length.

The second enlarged end preferably has a greater maximum depth than the first enlarged end. The second enlarged end preferably has a greater maximum width than the first enlarged end.

Each enlarged end preferably has a maximum width that is greater than its maximum depth. The interconnecting region preferably also has a maximum width greater than its maximum depth.

The second enlarged end preferably comprises a feature to assist in removal of the device from the vagina after insertion therein. The feature may comprise a cavity, recess, or the like, adapted to receive a user's digit, to enable the device to be pulled out of the vagina. Other types of removal features could be provided, such as a cord or ring for example.

In one embodiment, the body is resiliently compressible such that the body may be compressed by contracting the pelvic floor muscles. Preferably, the interconnecting region has greater flexibility than the first and second enlarged ends, to enable relative bending between the first and second enlarged ends and/or relative twisting or torsion between the first and second enlarged ends. That is particularly useful when the device is worn during exercise.

Preferably, the device is configured so that when the device is inserted, at least a major part of the sides of the device are in contact with the sides of the vagina so that the contraction of the pelvic floor muscles compresses a major part of the device.

The device may be sufficiently resilient so that it is capable of supporting the user's vaginal walls and bladder when inserted, but compresses upon contraction of the vaginal muscles and/or pelvic floor muscles.

The device may be configured such that the second enlarged end in particular is compressed upon contraction of the vaginal muscles. The second enlarged end is may be configured such that it compresses by about ⅓ to about 1/10 of its initial width and depth upon normal contraction of the pelvic floor muscles, preferably by about ⅕ to about ⅙, more preferably by about ⅛, under a pressure of about 60 N. It will be appreciated that the material for the device can be selected to provide any desired level of compressibility.

The device is preferably designed and configured such that it can remain inserted for extended durations during the user's normal activities.

The body of the device may be made from a single material. Alternatively, the body may have a core that is relatively rigid or incompressible in comparison to an outer layer that surrounds the core. The core will form a support structure, and the compressibility of the device will be provided by the outer layer.

In an alternative embodiment, the body is substantially rigid so that the device can resist muscle contraction without substantial deformation of the device. Preferably, the device is rigid so that there is no compression of the device during muscle contraction. In this embodiment, the device is preferably configured such that contracting the pelvic floor muscles causes the device to tilt or move towards the pubic bone.

The device is preferably manufactured from a bioderived, biodegradable material, such as wood pulp or polylactic acid for example. The body may be provided with a low friction, smooth coating to enhance insertion and removal of the device. Alternatively, the manufacturing process may ensure a smooth surface. The device may be a single use device that is readily disposable after use.

It will be appreciated that the device could be manufactured from any other suitable material, such as an elastomeric polymer like low density polyethylene for example.

Preferably, the device is substantially compostable. Preferably, the device is substantially biodegradable.

In accordance with a second aspect of the present invention, there is provided a kit for assisting a female human to exercise her pelvic floor muscles, comprising a device as outlined in relation to the first aspect above, and instructions for using the device.

Preferably, the kit comprises a plurality of said devices, each intended for a single use. Preferably, the kit comprises eighteen devices.

The instructions may comprise an exercise program for using the device, including details of exercises, numbers of repetitions, and an intended regularity of the exercises.

The kit may further comprise a lubricant, to assist in the insertion or removal of the device.

In accordance with a third aspect of the present invention, there is provided a method of exercising the pelvic floor muscles comprising the steps of:

(a) inserting a device according to the first aspect of the invention into the vagina, and (b) contracting said pelvic floor muscles against said device.

Preferably, the step of contracting said pelvic floor muscles is carried out for a predetermined amount of time and followed by the step of:

(c) relaxing said pelvic floor muscles.

Preferably, wherein steps (b) and (c) are repeated for a predetermined number of times.

Preferably, the method further comprises bracing the lower abdomen muscles before the step of contracting said pelvic floor muscles and breathing in and out during the step of contracting said pelvic floor muscles.

In accordance with a fourth aspect of the present invention, there is provided a method of preventing or alleviating the symptoms of urinary incontinence in a user comprising the steps of:

(a) inserting a device according to the first aspect of the invention into the vagina of the user, and (b) retaining the device in the vagina.

Preferably, the device is retained in the vagina for between about 5 minutes to about 12 hours. More preferably, the device is retained in the vagina for between about 5 minutes to about 8 hours. Most preferably, the device is retained in the vagina for between about 5 minutes to about 4 hours. Preferably, the device is retained in the vagina for at least about 20 minutes.

In accordance with a fifth aspect of the present invention, there is provided a method of preventing or alleviating the symptoms of stress incontinence in a user during exercise comprising the steps of:

(a) inserting a device according to the first aspect of the invention into the vagina of the user, and (b) exercising while the device remains inserted.

Preferably, the method prevents urinary stress incontinence.

In accordance with a sixth aspect of the present invention, there is provided a method of preventing or alleviating the symptoms of pelvic organ prolapse comprising the steps of:

(a) inserting a device according to the first aspect of the invention into the vagina of the user, and (b) retaining the device in the vagina.

Preferably, the device is retained in the vagina for between about 5 minutes to about 12 hours. More preferably, the device is retained in the vagina for between about 5 minutes to about 8 hours. Most preferably, the device is retained in the vagina for between about 5 minutes to about 4 hours. Preferably, the device is retained in the vagina for at least about 20 minutes.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting. Where specific integers are mentioned herein which have known equivalents in the art to which this invention relates, such known equivalents are deemed to be incorporated herein as if individually set forth.

The invention consists in the foregoing and also envisages constructions of which the following gives examples only.

BRIEF DESCRIPTION OF THE DRAWINGS

Preferred forms of the invention will now be described with reference to the accompanying figures in which.

DETAILED DESCRIPTION OF PREFERRED FORMS

Figure 1:
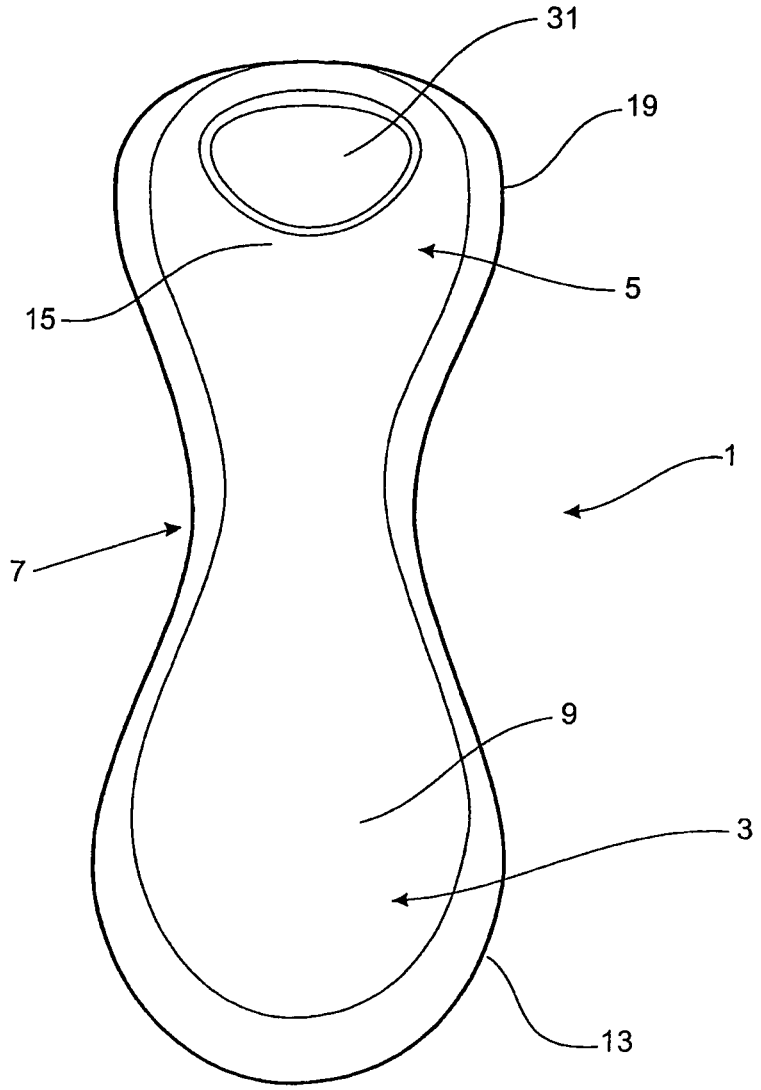
FIG. 1 is a plan view of a first preferred form of the device for supporting or exercising the pelvic floor muscles in a female human.

FIG. 1 shows a first preferred form of a device 1 for supporting or exercising the pelvic floor muscles in a female human. The device 1 comprises a unitary elongate body having a first enlarged end 3, a second enlarged end 5, and a relatively narrow interconnecting region or neck 7 between the first enlarged end 3 and the second enlarged end 5. As shown in the drawings, together the first enlarged end 3, the interconnecting region 7, and the second enlarged end 5 have a generally figure-eight-like outer shape.

Figure 2:
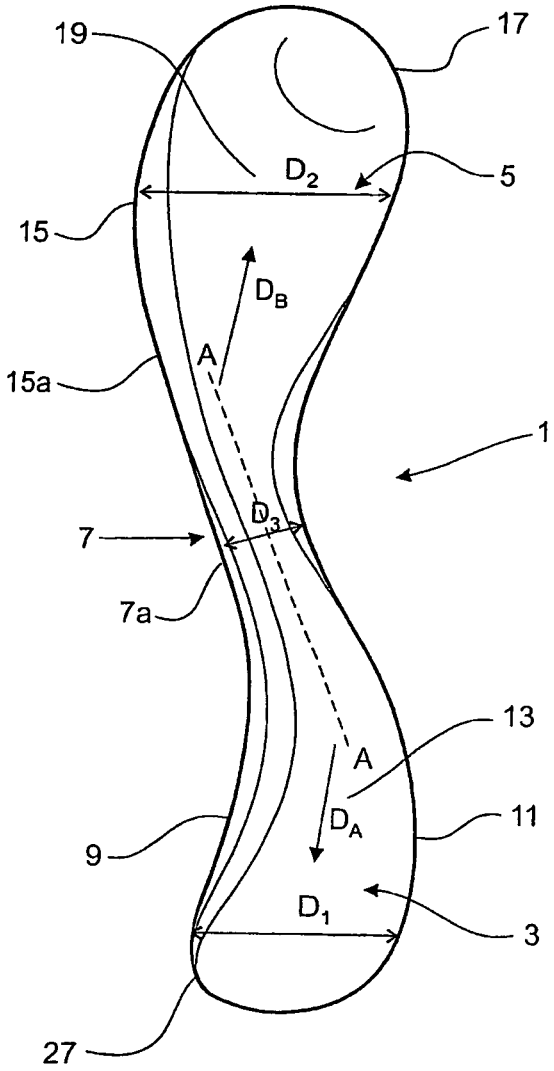
FIG. 2 is a side view of the first preferred form of the device of FIG. 1.

As can be seen best in FIG. 2, the first enlarged end 3 has a first surface 9 that is concave when viewed from an exterior of the device, and a second opposite surface 11 that is convex when viewed from the exterior of the device, such that the first enlarged end 3 defines an overall curvature.

The first enlarged end 3 has a perimeter 13 extending between the first surface 9 and the second surface 11, wherein the perimeter 13 is convex when viewed from the exterior of the device 1.

The second enlarged end 5 is bulbous, with a first surface 15 and a second opposite surface 17. As shown in the drawings, the first and second surfaces 15, 17 are continuous and each extends across a diameter that extends between the outermost edges of the second enlarged end 5. The first and second surfaces 15, 17 are convex when viewed from the exterior of the device. The second enlarged end 5 has a perimeter 19 extending between the first surface 15 and the second surface 17, wherein the perimeter 19 is generally convex when viewed from the exterior of the device.

As can be seen best in FIG. 2, the concave surface of the first enlarged end 9, an adjacent surface 7*a* of the interconnecting region 7 and part 15*a* of the adjacent surface of the second enlarged end 15 form a continuous surface that is generally concave or scooped when viewed from the exterior of the device 1.

The first preferred form of the device 1 has a generally sinuous shape along its length, with the first enlarged end 3 generally extending in a first direction $D_A$ from a first side of an axis AA extending through the interconnecting region 7 from one end of the interconnecting region 7. The second enlarged end 5 generally extends in a second direction $D_B$ from a second opposite side of the axis AA extending through the interconnecting region 7 from the other end of the interconnecting region 7. The first and second enlarged ends are generally parallel.

The second enlarged end 5 has a greater maximum depth $D_2$ than the maximum depth $D_1$ of the first enlarged end 3. The first enlarged end 3 has a greater maximum width $W_1$ than the maximum width $W_2$ of the second enlarged end 5.

Each enlarged end 3, 5 preferably has a maximum width W that is greater than its maximum depth D. The interconnecting region 7 preferably also has a maximum width $W_3$ greater than its maximum depth $D_3$.

Figure 3:
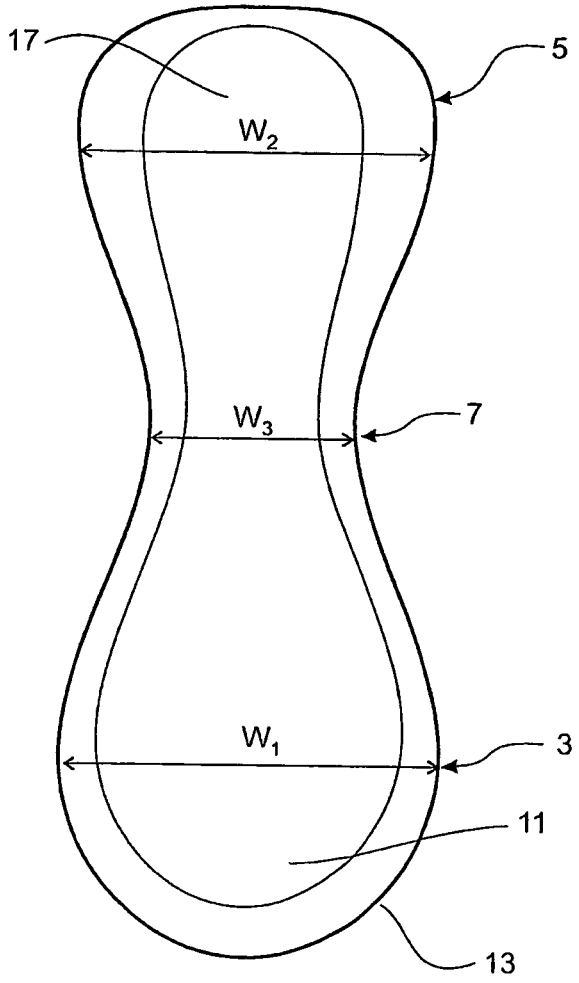
FIG. 3 is an underside view of the first preferred form of the device of FIG. 1.
Figure 4:
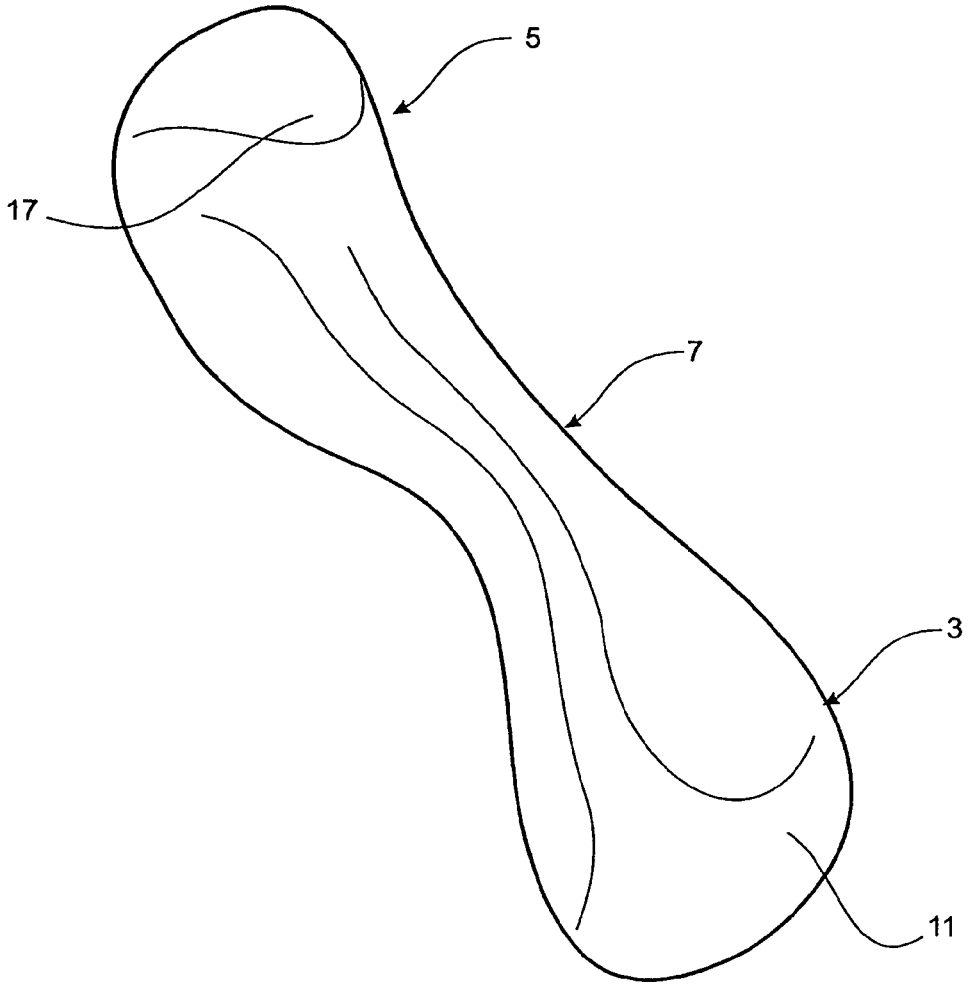
FIG. 4 is an underside perspective view of the first preferred form of the device of FIG. 1.
Figure 5:
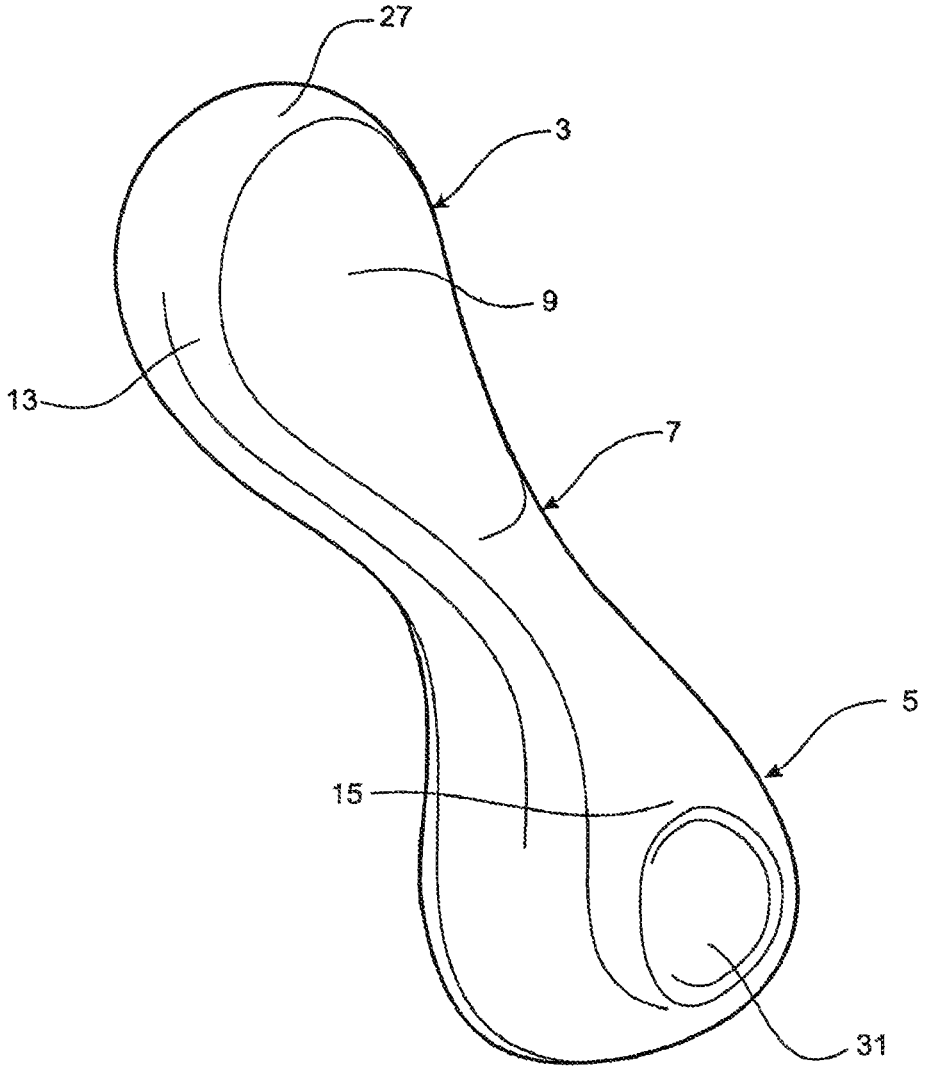
FIG. 5 is an overhead perspective view of the first preferred form of the device of FIG. 1.
Figure 6:
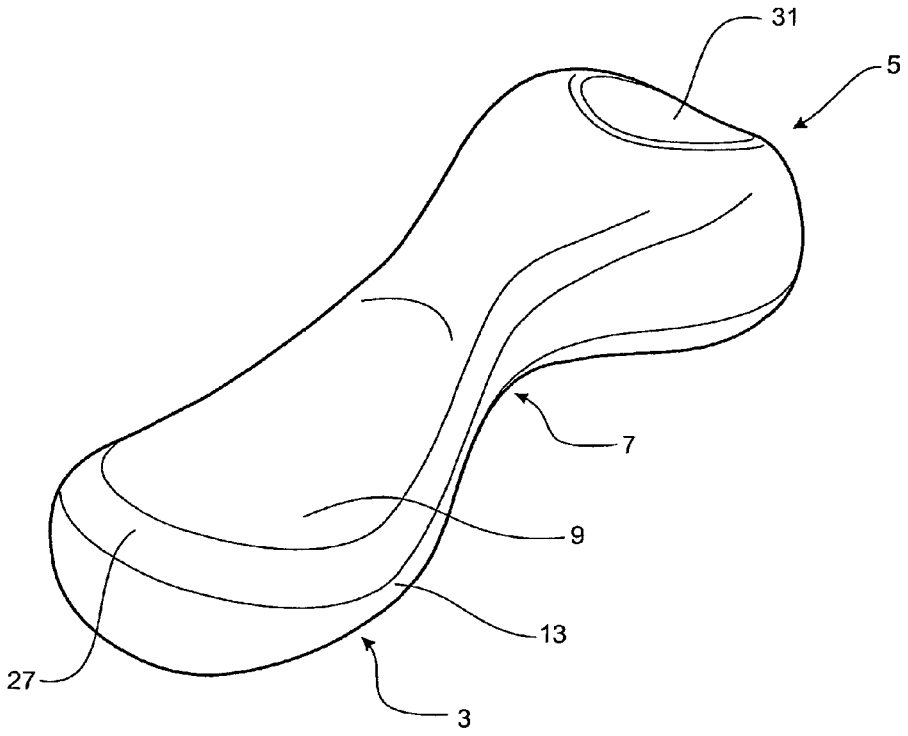
FIG. 6 is an alternative overhead perspective view of the first preferred form of the device of FIG. 1.

Referring to FIG. 3, the maximum width $W_1$ of the first enlarged end 3 is between about 10 mm and 50 mm, more preferably between about 20 mm and about 45 mm, more preferably between about 35 mm and about 40 mm, more preferably about 38 mm, most preferably 37.6 mm. The maximum width $W_2$ of the second enlarged end 5 is between about 10 mm and about 50 mm, more preferably between about 20 mm and about 45 mm, more preferably between about 35 mm and about 40 mm, more preferably about 36 mm, most preferably 35.7 mm. The maximum width $W_3$ of the interconnecting region 7 is between about 5 mm and about 50 mm, more preferably between about 10 mm and about 30 mm, more preferably between about 15 mm and about 25 mm, most preferably 20 mm. The length of the device 1 from the tip of the first enlarged end 3 to the narrowest portion of the interconnecting region 7 is between about 35 mm and about 70 mm, more preferably between about 45 and about 60 mm, more preferably about 55 mm, most preferably 55.1 mm. The overall length of the device is preferably about 80 mm to about 1.00 mm, more preferably about 95 mm.

Referring to FIG. 2, the minimum depth $D_3$ of the interconnecting region 7 is between about 2 mm and about 20 mm, preferably between about 4 mm and about 15 mm, more preferably between about 5 mm and about 10 mm, most preferably 8 mm. The maximum depth $D_1$ of the first enlarged end 3 is between about 10 mm and about 30 mm, preferably between about 15 mm and about 25 mm, more preferably about 19 mm, more preferably about 19.1 mm, most preferably 19.14 mm. The maximum depth $D_2$ of the second enlarged end 5 is between about 10 mm and about 40 mm, more preferably between about 20 mm and about 30 mm, more preferably about 25 mm, most preferably 24.64 mm.

It is preferred that at least the depth of the interconnecting region is less than the depths of the first second ends. It is further preferred that the width of the interconnecting region is less than the widths of the first and second ends, although the width could be relatively constant along the length of the device.

In other embodiments the proportions and/or dimensions of the device can vary depending on whether the user is nulliparous, multiparous, pre-menopausal or post-menopausal. The proportions and/or dimensions of the device can vary depending on the material(s) the device is manufactured from and the manufacturing method used.

Figure 7:
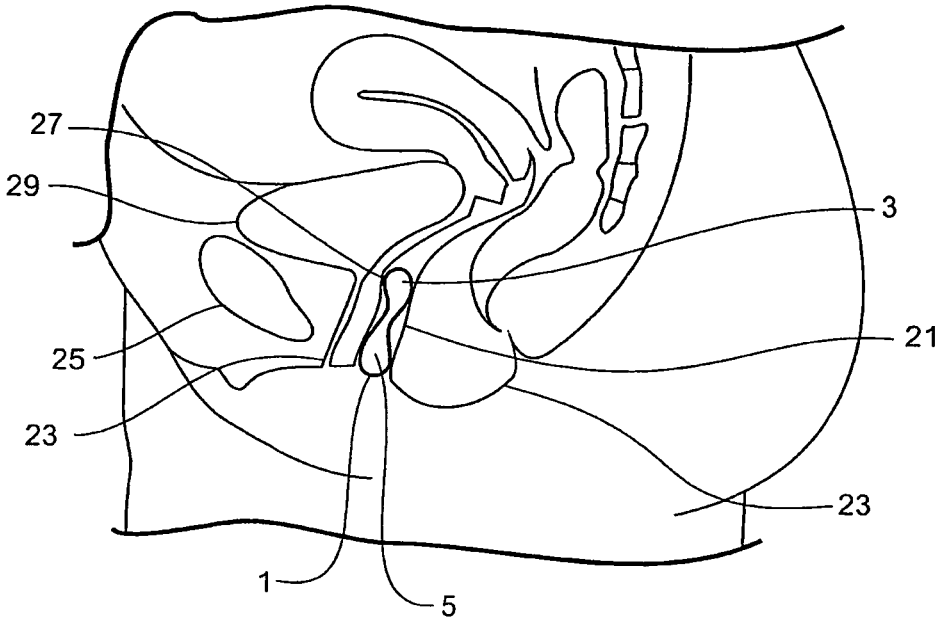
FIG. 7 is a cross-sectional view of the first preferred form of the device in a female human in use.

FIG. 7 shows the first preferred form of the device 1 in use. Preferably, the device 1 is fully inserted into the vagina 21 in the orientation shown. The first enlarged end 3 is inserted first. The first surface 9 of the first enlarged end 3 is positioned anteriorly, with the second surface 11 positioned posterially.

The device 1 is designed and configured such that it can remain inserted for extended durations during normal activities of the user.

The shape of the device 1 is configured to accommodate the protrusion in the anterior vaginal wall formed by the pubic bone 25. Additionally, the interconnecting region 7 has a narrower depth and width than the enlarged ends 3, 5, to minimise or prevent unwanted longitudinal movement of the device once inserted in the vagina 21.

The first preferred form of device 1 is configured such that it can be compressed by contracting the pelvic floor muscles when the device 1 is inserted. At least a major part of the sides of the device 1 are in contact with the sides of the vagina 21 so that contraction of the pelvic floor muscles compresses a major part of the device. To exercise the pelvic floor muscles the user contracts the pelvic floor muscles 23 against the device 1. The first preferred form of the device 1 is resiliently compressible and therefore deforms under the pressure of the muscle contraction.

The interconnecting region 7 of the first preferred form of has greater flexibility than the first and second enlarged ends 3, 5, to enable relative bending between the first and second enlarged ends 3, 5 and/or relative twisting or torsion between the first and second enlarged ends 3, 5. This flexibility ensures that the user can perform a full range of pelvic movements without experiencing discomfort.

Therefore, the configuration of the device 1 enables the device to remain in position in the vagina 21 for long periods even when the user exercises throughout the period.

The intersection of the outer end of the first surface 9 of the first enlarged end 3 and the perimeter 13 forms a tip 27. The tip 27 is configured to apply pressure against the anterior vaginal wall during contraction of the muscles, in some embodiments of the first preferred form of the device. The device 1 is shaped such that the tip 27 will apply pressure to the bladder neck or part of the anterior vaginal wall known as the G-spot. The G-spot is thought to be the most sensitive area of the vaginal wall. Pressure applied to this area by the tip 27 will be sensed by the user, so that the user is aware of the position of the device. The device may also move upwards during contraction of the muscles.

The first preferred form of the device 1 is preferably sufficiently resilient such that it is capable of supporting the user's vaginal walls and bladder when inserted, but compresses upon contraction of the vaginal muscles and/or pelvic floor muscles.

Embodiments of the first preferred form of the device 1 may have variable compressibility to suit to requirements of the particular individual. Preferably, the second enlarged end 5 compresses by about ⅓ to about 1/10, preferably by about ⅕ to about ⅙, more preferably by about ⅛ of its initial width and depth, upon contraction of the muscles under a pressure of about 60 N.

It will be appreciated that other levels of compressibility can be provided. The device may be substantially or totally rigid, as described below in relation to the second preferred form of the device.

The device 1 can also be used to provide support for the tissues of the pelvis. When inserted, the device 1 holds the bladder and other pelvic organs in position, preventing or alleviating the symptoms of pelvic organ prolapse.

The device 1 is particularly suited for supporting the pelvic organs during exercise, as it can remain comfortably inserted while the user performs a full range of body motions. The shape of the device 1 ensures that it remains in the correct position and does not slip longitudinally to an uncomfortable or dangerous position. The curvature of the device assists the device to stay in place by sitting on the pubic bone shelf. The shape is also designed to anatomically reduce the potential descent or dropping of the device as a woman performs the pelvic floor exercises.

Referring to FIGS. 1-6, the second enlarged end 5 comprises a feature to assist in removal of the device from the vagina after insertion therein. In the embodiment shown the feature comprises a recess adapted to receive a user's digit, to enable the device to be pulled out of the vagina. In other embodiments the feature may comprise a cavity or the like. Other types of removal features could be provided, such as a cord or ring for example. The cord or ring may be fully insertable in the vagina, or may be configured to be external of the vaginal opening in use.

The removal feature can also be used to aid insertion. Before insertion, the device is oriented with the removal feature facing upwards to ensure the device is oriented correctly in use.

The device of the invention is shaped for easy self-insertion into the vagina. Once inserted, the device fits ergonomically to the natural contours of the vagina and will not move position, even when the user exercises or runs.

Referring to FIGS. 8-12, a second preferred form of the device 101 is shown. Unless described below, the features and operation should be considered to be the same as those described above and like numerals are used to indicate like parts, with the addition of 100.

The second preferred form of the device 101 differs from the first preferred device in that it is rigid. The rigidity of the device provides resistance to the pelvic floor muscles during contraction of those muscles. This form of the device is sufficiently rigid to resist the muscle contraction without substantial deformation of the device, and is preferably totally rigid so the device does not compress at all during muscle contraction.

The second preferred from device is inserted in a similar manner to the first preferred form of the device, into the position shown in FIG. 7. In use, the pelvic floor muscles contract around the second enlarged end of the device 101. The introitus of the vagina (vaginal opening) is muscular and when a voluntary contraction and relaxation occurs, the second enlarged end moves in a posterior/anterior direction. Contraction causes the tip 127 of the device to tilt or move towards the pubic bone. This tilting action has been seen on ultrasound imaging with highly trained pelvic floor muscles. The device 101 is shaped such that, during contraction, the tip 127 will apply pressure to the bladder neck or part of the anterior vaginal wall. The device may also move upwards during contraction. Pressure applied to the anterior vaginal wall by the tip 127 will be sensed by the user, so that the user is aware of the position of the device. This provides biofeedback to the user. The device returns to the original insertion position when the pelvic floor muscles are relaxed.

Figure 8:
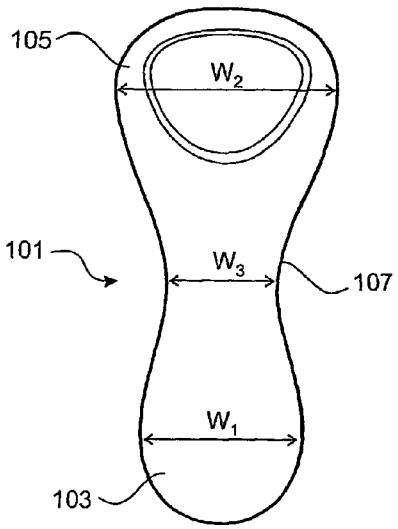
FIG. 8 is a plan view of a second preferred form of the device for supporting or exercising the pelvic floor muscles in a female human.

Referring to FIG. 8, the dimensions of the second preferred form are within the range of dimensions described above in relation to the first preferred form of the device. The first enlarged end 103 of the second preferred form of the device has a smaller thickness and width than the first enlarged end 3 of the first preferred form of the device.

In the embodiment shown, the maximum width $W_1$ of the first enlarged end 103 is preferably about 35 mm, most preferably 34.5 mm, the maximum width $W_2$ of the second enlarged end 105 is preferably about 26 mm, most preferably 25.5 mm, and the maximum width $W_3$ of the interconnecting region 107 is preferably about 17 mm, most preferably 17.1 mm. The length of the device 101 from the tip of the first enlarged end 103 to the narrowest portion of the interconnecting region 7, when viewed as shown in FIG. 8, is preferably about 44 mm, most preferably 44.3 mm. The overall length of the device is preferably about 83 mm, most preferably about 82.5 mm.

Figure 9:
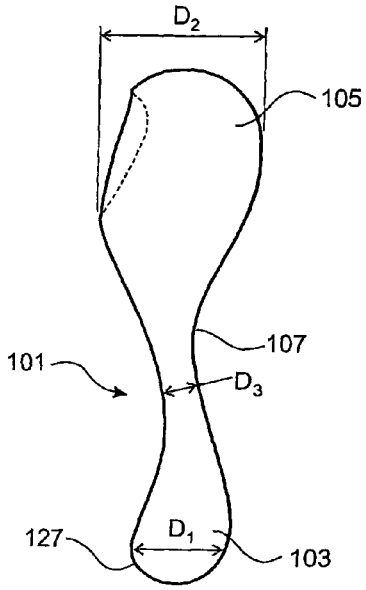
FIG. 9 is a side view of the second preferred form of the device of FIG. 8.
Figure 10:
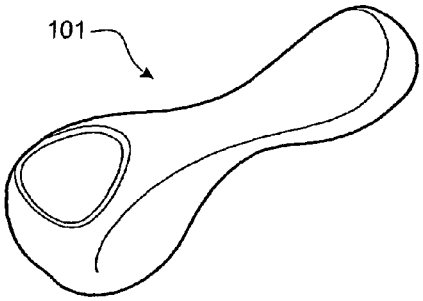
FIG. 10 an overhead perspective view of the second preferred form of the device of FIG. 8.
Figure 11:
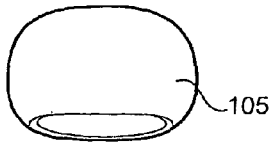
FIG. 11 is an end view from the first enlarged end of the second preferred form of the device of FIG. 8.
Figure 12:
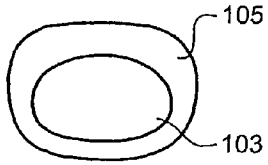
FIG. 12 is an end view from the second enlarged end of the second preferred form of the device of FIG. 8.

Referring to FIG. 9, the minimum depth $D_3$ of the interconnecting region 107 is most preferably 6 mm, the maximum depth $D_1$ of the first enlarged end 103 is preferably about 16 mm, most preferably about 15.8 mm, the maximum depth $D_2$ of the second enlarged end 105 is more preferably about 25 mm, most preferably 25.4 mm.

In embodiments of either preferred form of the device, the insertion end may be shaped and dimensioned to touch the anterior vaginal wall and the posterior bladder wall, allowing for a secondary feedback point.

The second preferred form of the device 101 can also be used to provide support for the tissues of the pelvis and support the pelvic organs during exercise, as described above in relation to the first preferred form of the device.

The body of the first preferred form of the device may be made from a single material. Alternatively, the body of the first preferred form of the device may have a core that is relatively rigid or incompressible in comparison to an outer layer that surrounds the core. The core will form a support structure, and the compressibility of the device will be provided by the outer layer. The body of the second preferred form of the device may be made from a single material or a combination of materials.

Either preferred form of the device may be manufactured from a bioderived, biodegradable, or compostable material, such as wood pulp or polylactic acid for example. The body of either preferred form of the device may be provided with a low friction, smooth coating to enhance insertion and removal of the device. Alternatively, the manufacturing process may ensure a smooth surface. Either preferred form of the device may be a single use device that is readily disposable after use.

It will be appreciated that the device could be manufactured from any other suitable material, such as an elastomeric polymer like low density polyethylene, for example.

The first preferred form of the device may be manufactured any other suitable resilient or compressible material(s), such as silicone.

The second preferred form of the device may be manufactured from polycarbonate. It will be appreciated that the device can be made from any other suitable substantially or totally rigid material(s).

The device 1 can be made using standard polymer shaping techniques in the art, for example, injection moulding or blow moulding. The device may be solid, hollow, or be formed with one or more cavities depending on the material chosen for the device and the shaping technique used to form the device.

The device may be provided in a kit for assisting a female human to exercise her pelvic floor muscles. The kit will comprise the device 1 or 101, and instructions for using the device.

The kit may comprise a plurality of said devices, each intended for a single use. For example, the kit preferably comprises eighteen devices. The kit could be provided with a different number of devices. Alternatively, the kit may comprise a single reusable device.

The instructions of the kit may comprise an exercise program for using the device, including details of exercises, numbers of repetitions, and an intended regularity of the exercises. The device 1 or 101 can be used in conjunction with any exercise program. The device 1 or 101 can be used in conjunction with other pelvic floor exercises that do not require the device. Preferably the instructions specify use of the device 1 or 101 once per day, three times per week for 6 to 12 weeks.

The kit may further comprise a lubricant, to assist in the insertion or removal of the device.

The first preferred form device can be used in a method of exercising the pelvic floor muscles comprising the steps of:

(a) inserting a device according to the first aspect of the invention into the vagina, and (b) contracting said pelvic floor muscles against said device.

The second preferred from device can be used in a method of exercising the pelvic floor muscles comprising the steps of:

(a) inserting a device according to the first aspect of the invention into the vagina, and (b) contracting said pelvic floor muscles to tilt or move the device towards the pubic bone.

The method of the invention can be adapted for use with any pelvic floor exercise program. Example 1 provides an example of a preferred exercise program suitable for use with the method of the invention. The exercise program can be performed in different positions including, lying, sitting, standing or walking.

In addition to exercising the pelvic floor muscles, the device can also be used to prevent urinary incontinence, by (a) inserting the device according to the first aspect of the invention into the vagina of the user, and (b) retaining the device in the vagina.

Preferably, the device is retained in the vagina for between about 5 minutes to about 12 hours. More preferably, the device is retained in the vagina for between about 5 minutes to about 8 hours. Most preferably, the device is retained in the vagina for between about 5 minutes to about 4 hours. Preferably, the device is retained in the vagina for at least about 20 minutes.

The device Can be used to prevent stress incontinence in a user during exercise, by (a) inserting a device according to the first aspect of the invention into the vagina, and (b) exercising while the device remains inserted.

When inserted the device will support the bladder and pelvic floor muscles, such that the user is able to control the opening of the urethra to prevent urinary incontinence.

The device can be used to prevent or alleviate the symptoms of pelvic organ prolapse, by (a) inserting a device according to the first aspect of the invention into the vagina, and (b) retaining the device in the vagina.

Preferably, the device is retained in the vagina for between about 5 minutes to about 12 hours. More preferably, the device is retained in the vagina for between about 5 minutes to about 8 hours. Most preferably, the device is retained in the vagina for between about 5 minutes to about 4 hours. Preferably, the device is retained in the vagina for at least about 20 minutes.

When performing the above methods, the device is preferably inserted for at least about 20 minutes and up to about 12 hours, more preferably about 8 hours, most preferably up to about 4 hours.

When inserted as shown in FIG. 7, the device acts as a framework to support the pelvic organs.

The above describes preferred forms of the present invention only, and modifications may be made thereto without departing from the scope of the invention.

EXAMPLES

Example 1

Method of Exercising Pelvic Floor Muscles (a) insert the device of the invention comfortably so it is just inside the vagina, (b) place your hands on your lower abdomen (tummy) as if placing them in front pockets to feel the movement of your inner muscles, (c) brace your tummy muscles (d) breathe in and out to the base of the lungs (e) contract your pelvic floor muscles against the device and hold (f) release all muscles and relax.

Steps (a) to (e) constitute one cycle.

10 cycles should be performed every second day for 12 weeks.

Exercisers should aim to be able to do 10-12 cycles in a row, holding each squeeze for 6-8 seconds. Exercisers should also aim to do 3 sets of 10-12 cycles each day. In addition, exercisers can perform a further set of 10-12 cycles of steps (d) to (f) without performing step (c) first.

What is claimed is:

1. A device for exercising and strengthening pelvic floor muscles of a female human having a vagina with an anterior vaginal wall and a vaginal opening, the device comprising:

a tip end portion configured to be inserted into the vagina and spaced inwardly from the vaginal opening, the tip end portion comprising a first surface opposite a second surface, the first surface being generally concave when viewed from an exterior of the device, and the second surface being generally convex when viewed from the exterior of the device;

a base end portion configured to be inserted into the vagina and positioned adjacent the pelvic floor muscles to provide resistance to contraction of the pelvic floor muscles, the base end portion being positioned nearer the vaginal opening than the tip end portion when the tip and base end portions are both inserted into the vagina, the base end portion being larger than the tip end portion and having a continuous surface across a diameter extending between its outermost edges; and a curved interconnecting region that interconnects the tip end portion and the base end portion, together the tip end portion, the interconnecting region, and the base end portion having a generally figure-eight-like outer shape, the interconnecting region having a first curved portion adjacent the tip end portion, a second curved portion adjacent the base end portion, and an intermediate portion extending between the first and second curved portions, the intermediate portion being narrower than the tip and base end portions, a portion of the intermediate portion being narrower than the first and second curved portions, wherein, when the tip and base end portions are both inserted into the vagina, the first curved portion positions the tip end portion to extend away from the intermediate portion in an inward and anterior direction with the concave first surface being adjacent the anterior vaginal wall, the second curved portion positions the intermediate portion to extend away from the base end portion in an inward and posterior direction, and contracting the pelvic floor muscles adjacent the base end portion presses the tip end portion against the anterior vaginal wall.

2. The device of claim 1, wherein the tip end portion comprises:

a perimeter extending between the first surface and second surface, wherein the perimeter is generally convex when viewed from the exterior of the device.

3. The device of claim 1, wherein the base end portion is generally bulbous, with first and second opposite surfaces that are generally convex when viewed from the exterior of the device.

4. The device of claim 1, wherein the base end portion has a greater maximum depth than the tip end portion.

5. The device of claim 1, wherein the base end portion has a greater maximum width than the tip end portion.

6. The device of claim 1, wherein the tip end portion has a maximum width, and a maximum depth, the base end portion has a maximum width, and a maximum depth, the maximum width of the tip end portion is greater than the maximum depth of the tip end portion, and the maximum width of the base end portion is greater than the maximum depth of the base end portion.

7. The device of claim 1, wherein the intermediate portion of the interconnecting region has a maximum width and a maximum depth, and the maximum width of the intermediate portion is greater than the maximum depth of the intermediate portion.

8. The device of claim 1 for use with the human female having a finger, wherein the base end portion comprises a recess configured to receive the finger during removal of the tip and base end portions from the vagina after insertion therein.

9. The device of claim 1, wherein the base end portion is rigid and does not compress when the base end portion is inserted into the vagina and the pelvic floor muscles adjacent the base end portion are contracted.

10. The device of claim 9, wherein the tip end portion and the interconnecting region are both rigid.

11. The device of claim 1, wherein when the tip and base end portions are both inserted into the vagina and the pelvic floor muscles adjacent the base end portion are contracted, the tip end portion tilts or moves inside the vagina relative to the base end portion towards the pubic bone.

12. The device of claim 1, wherein the device is substantially compostable.

13. The device of claim 1, wherein the device is substantially biodegradable.

14. A method of exercising pelvic floor muscles performed by a human female having a vagina with an anterior vaginal wall and a vaginal opening, the method comprising:

(a) inserting a device for exercising the pelvic floor muscles into the vagina, the device comprising:

a tip end portion configured to be inserted into the vagina and spaced inwardly from the vaginal opening, the tip end portion comprising a first surface opposite a second surface, the first surface being generally concave when viewed from an exterior of the device, and the second surface being generally convex when viewed from the exterior of the device;

a base end portion configured to be inserted into the vagina and positioned adjacent the pelvic floor muscles to provide resistance to contraction of the pelvic floor muscles, the base end portion being positioned nearer the vaginal opening than the tip end portion when the tip and base end portions are both inserted into the vagina, the base end portion being larger than the tip end portion and having a continuous surface across a diameter extending between its outermost edges; and a curved interconnecting region that interconnects the tip end portion and the base end portion, together the tip end portion, the interconnecting region, and the base end portion having a generally figure-eight-like outer shape, the interconnecting region having a first curved portion adjacent the tip end portion, a second curved portion adjacent the base end portion, and an intermediate portion extending between the first and second curved portions, the intermediate portion being narrower than the tip and base end portions, a portion of the intermediate portion being narrower than the first and second curved portions, wherein, when the tip and base end portions are both inserted into the vagina, the first curved portion positions the tip end portion to extend away from the intermediate portion in an inward and anterior direction with the concave first surface being adjacent the anterior vaginal wall, the second curved portion positions the intermediate portion to extend away from the base end portion in an inward and posterior direction, and contracting the pelvic floor muscles adjacent the base end portion presses the tip end portion against the anterior vaginal wall; and (b) after the device has been inserted, contracting the pelvic floor muscles against the base end portion of the device to thereby press the tip end portion against the anterior vaginal wall.

15. The method of claim 14 wherein the pelvic floor muscles are contracted against the device for a predetermined amount of time, and the method further comprises:

(c) relaxing the pelvic floor muscles after they have been contracted for the predetermined amount of time.

16. The method of claim 15, further comprising:

repeating the contracting and the relaxing of the pelvic floor muscles a predetermined number of times.

17. The method of claim 14 performed by the female human having lower abdomen muscles, the method further comprising:

bracing the lower abdomen muscles before contracting the pelvic floor muscles; and breathing in and out during the contracting of the pelvic floor muscles.

18. The method of claim 14, wherein the device remains inserted in the vagina for between about 5 minutes and about 12 hours.

19. The method of claim 18, wherein the device remains inserted in the vagina for between about 5 minutes and about 8 hours.

20. The method of claim 19, wherein the device remains inserted in the vagina for between about 5 minutes and about 4 hours.

21. The method of claim 18, wherein the device remains inserted in the vagina for about 5 minutes.

22. The method of claim 14, further comprising:

repeating the contracting of the pelvic floor muscles while the device remains inserted in the vagina; and relaxing the pelvic floor muscles between repetitions of the contracting.

23. The device of claim 1 for use with the human female having a pubic bone and a protrusion in the anterior vaginal wall formed by the pubic bone, wherein the first curved portion, the second curved portion, and the intermediate portion are configured to accommodate the protrusion in the anterior vaginal wall formed by the pubic bone when the tip and base end portions are both inserted into the vagina.

24. The device of claim 1 for use with the human female having a pubic bone and a protrusion in the anterior vaginal wall formed by the pubic bone, wherein the interconnecting region comprises a surface contiguous with the concave first surface of the tip end portion, the surface of the interconnecting region extending along the first curved portion, and the intermediate portion, and together the concave first surface of the tip end portion and the surface of the interconnecting region have a concave or scooped shape configured to extend alongside the protrusion in the anterior vaginal wall formed by the pubic bone when the tip and base end portions are both inserted into the vagina.

25. The device of claim 1 for use with the human female having a bladder neck, and the anterior vaginal wall comprising a G-spot, wherein when the tip and base end portions are both inserted into the vagina and the pelvic floor muscles adjacent the base end portion are contracted, the tip end portion applies pressure to at least one of the bladder neck and the G-spot.

26. The device of claim 1, wherein the base end portion is configured to move inwardly from an initial position when the tip and base end portions are both inserted into the vagina and the pelvic floor muscles adjacent the base end portion are contracted, and the base end portion is configured to return to the initial position when the pelvic floor muscles adjacent the base end portion are relaxed after having been contracted.

27. The device of claim 1, further comprising:

a smooth contoured outer surface extending around the tip end portion, the base end portion, and the interconnecting region.

* * * * *